US006381868B1

(12) United States Patent
Grabscheid et al.

(10) Patent No.: US 6,381,868 B1
(45) Date of Patent: May 7, 2002

(54) DEVICE FOR DEWATERING A MATERIAL WEB

(75) Inventors: Joachim Grabscheid, Gerstetten; Karl Josef Böck; Ulrich Begemann, both of Heidenheim; Thomas Elenz, Steinheim; Peter Mirsberger, Baienfurt; Hans Dahl, Ravensburg, all of (DE); Hannes Vomhoff, Djursholm (SE); David Beck, Appleton, WI (US)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/675,653

(22) Filed: Sep. 29, 2000

(30) Foreign Application Priority Data

Sep. 30, 1999 (DE) ..... 199 46 971

(51) Int. Cl.[7] ..... D06F 58/00; F26B 11/02
(52) U.S. Cl. ..... 34/114; 34/456; 162/360.3
(58) Field of Search ..... 34/108–109, 111, 34/114, 113, 116–117, 120, 122, 123, 127, 130, 636, 651, 662–664, 402, 417, 444, 455–457; 162/360.3

(56) References Cited

U.S. PATENT DOCUMENTS 3,293,121 A 12/1966 Martin
3,315,370 A * 4/1967 Hikosaka ..... 34/70
4,173,249 A * 11/1979 Holkko et al. ..... 162/358.3
4,675,079 A * 6/1987 Webster ..... 162/360.3

FOREIGN PATENT DOCUMENTS

| | | |
|---|---|---|
| DE | 2364346 | 10/1975 |
| DE | 2829226 | 1/1979 |
| DE | 19613339 | 10/1997 |
| DE | 19627890 | 1/1998 |
| EP | 0069667 | 1/1983 |

* cited by examiner

*Primary Examiner*—Teresa Walberg
*Assistant Examiner*—Thor Campbell
(74) *Attorney, Agent, or Firm*—Greenblum & Bernstein P.L.C.

(57) ABSTRACT

Apparatus and process for dewatering a material web. The apparatus includes at least one pressure chamber formed by at least four substantially parallel rolls, a device arranged to introduce a pressurized gas into the at least one pressure chamber, and the at least four substantially parallel rolls being displaceable relative to one another to change an effective area of the at least one pressure chamber. The material web is guided through the at least one pressure chamber. The process includes pressurizing at least one pressure chamber with a gas medium, guiding the material web through the pressure chamber, driving water out of the material web using gas pressure within the at least one pressure chamber, and changing an effective area of the pressure chamber so as to adjust a dewatering capacity.

32 Claims, 1 Drawing Sheet

DEVICE FOR DEWATERING A MATERIAL WEB

CROSS-REFERENCE TO RELATED APPLICATIONS

The present application claims priority under 35 U.S.C. §119 of German Patent Application No. 199 46 971.7, filed on Sep. 30, 1999, the disclosure of which is expressly incorporated by reference herein in its entirety.

BACKGROUND OF THE INVENTION

1. Field of the Invention

The invention relates to a device for dewatering a material web, in particular a paper or cardboard web, by driving water out of the material web by gas pressure. the device includes having at least one pressure chamber limited by at least four rolls arranged parallel to one another and arranged to form a pressure chamber of which a pressurized gas can be introduced and through which the material web can be guided.

2. Discussion of Background Information

In such a process, instead of a mechanical compression of the material web, the pressurized gas is pressed through the material web and the water is driven out of the material web in this manner.

SUMMARY OF THE INVENTION

An aspect of the invention is to produce a device of the above-mentioned type for dewatering a material web that can be used in as many functions as possible. This device for dewatering a material web, in particular a paper or cardboard web, by driving water out of the material web using gas pressure, having at least one pressure chamber limited by at least four rolls arranged parallel to one another into which a pressurized gas can be introduced and through which the material web can be guided, with the positions of the rolls being displaceable relative to one another. Moreover, the positions of the rolls can be adjusted relative to one another.

According to the invention, the geometry and the form of the pressure chamber can be changed by the adjustability of the relative arrangement of the rolls. This creates the possibility of deliberately varying the length of the path traveled by the material web inside the pressure chamber.

According to the invention, a dwell time of the material web inside the pressure chamber can be set to any desired value by adjusting the roll position. The dewatering device according to the invention can thus be used in many different functions and for a plurality of material types. In a machine for producing a paper or cardboard web, for example, the requirements for different types of paper or cardboard can be taken into account using only one dewatering device according to the invention in that, by adjusting the relative roll positions, the necessary dwell time for the respective web to be dewatered inside the pressure chamber can be set.

It is preferred for the positions of the rolls to be adjustable while maintaining a pressure chamber that is limited by the rolls at all times. By adjusting the roll positions, the pressure chamber is maintained as such. Only the geometry and/or form of the pressure chamber is changed by adjusting the rolls.

According to another preferred embodiment of the invention, two rolls lying across from one another can each automatically track an adjusting movement of at least one of the two other rolls. Thus, it is necessary to adjust the position of only one single roll because the automatic tracking of the two rolls that are facing one another assures that the desired roll configuration is set at the end of the adjusting movement.

It is preferred for each of the two rolls lying across from one another to be prestressed in contact with both of the other rolls, with the distance between the two other rolls being adjustable.

The prestressing causes the two rolls lying across from one another to be pressed against both of the other rolls and to remain in contact with the other rolls, thereby maintaining a pressure chamber limited by all four rolls, when the distance between the other two rolls is changed for the purpose of setting the desired roll configuration. It is preferred for both prestressed rolls to have a smaller diameter than the other two rolls.

According to one variant of the invention, the prestressing of the rolls can be achieved in that the prestressed rolls are each coupled by at least one prestressing device to a stationary support. The prestressing devices can, for example, be elastically deformable and, e.g., embodied as arrangements of pressure springs, each of which are supported at one end on the stationary support and are connected with the respective roll on the other end.

According to another variant of the invention, the prestressing of the rolls is achieved in that the rolls are coupled with one another by way of at least one prestressing device. The prestressing device, which is embodied, for example, as being elastically deformable and, e.g., embodied as a tension spring, attempts to move the two rolls toward one another, whereby the two prestressed rolls are pressed against both of the other rolls.

The prestressing devices can also be embodied as hydraulic or pneumatic cylinders. The contact force of the roll can be predetermined thereby using the fluid and/or gas pressure, in which connection the fluid and/or gas can be adjusted by a control and/or regulation device, in particular dependent upon the pressure prevailing in the pressure chamber. With such an adjustable prestressing device, the mechanical pressure on the material web in the entrance nip and exit nip of the pressure chamber can be varied. In this manner, a pre- and/or post compression of the material web is achieved whose effectiveness is deliberately adjustable.

In all variants of the invention listed above, the prestressed rolls are kept permanently in contact with the two other rolls so that, in the case of an adjusting movement, at least one of the two other rolls can follow the prestressed roll making the adjusting movement and a pressure chamber with the desired geometry and/or form that is limited by all four rolls is present at the end of the adjusting movement.

The present invention further provides a process for dewatering a material web, in particular a paper or cardboard web, by driving water out of the material web by gas pressure, in which a pressurized gas is introduced into at least one pressure chamber and the material web is guided through the pressure chamber. The area of effect of the pressure chamber is changed in the travel direction of the material web, in particular its effective length, for the purpose of adjusting the dewatering capacity of the area of effect of the pressure chamber.

With such a process, the dwell time of the material web in the pressure chamber, and thus the dewatering capacity, can be adjusted in the desired manner by changing the area of effect of the pressure chamber.

Advantageous embodiments of the invention are also provided in the claims, the description, and the drawings.

According to an aspect of the invention an apparatus for dewatering a material web is provided which includes at least one pressure chamber formed by at least four substantially parallel rolls, a device arranged to introduce a pressurized gas into the at least one pressure chamber, and the at least four substantially parallel rolls being displaceable relative to one another to change an effective area of the at least one pressure chamber. The material web is guided through the at least one pressure chamber.

According to another aspect of the present invention the material web is one of a paper and cardboard web. Additionally, other aspects of the present invention include driving water out of the material web using the pressurized gas. In another aspect of the present invention positions of the at least four substantially parallel rolls are adjustable while a pressure within the at least one pressure chamber is maintained.

According to a further aspect of the present invention a first pair of rolls of the at least four substantially parallel rolls are configured across from one another and a position of the first pair of rolls is adopted to follow a movement of at least one of the remaining rolls of the at least four substantially parallel rolls.

In another aspect of the present invention, the invention includes at least one prestressing device. A first pair of rolls of the at least four substantially parallel rolls are configured across from one another, the at least one prestressing device is arranged to prestress the first pair of rolls in contact with the remaining rolls of the at least four substantially parallel rolls by at least one prestressing device, and a distance between the remaining rolls is adjustable.

According to a further aspect of the present invention, the first pair of rolls have a smaller diameter than the remaining rolls of the at least four substantially parallel rolls. In another aspect of the present invention, the first pair of rolls have a substantially smaller diameter than the remaining rolls of the at least four substantially parallel rolls.

In another aspect of the present invention, the apparatus includes a roll support. One roll of the first pair of rolls is fixed firmly on the roll support and an other of the first pair of rolls is mounted for movement relative to the fixed one roll.

According to a still further aspect of the present invention at least one stationary support, wherein each roll of the first pair of rolls are coupled to the at least one stationary support by the at least one prestressing device.

Further aspects of the invention include a pressure spring arrangement. According to other aspects of the present invention the at least one prestressing device is arranged to couple said first pair of rolls to one another. According to other aspects of the present invention the at least one prestressing device is a tension spring arrangement.

According to another aspect of the present invention the at least one prestressing device is structured and arranged in such a way that prestressing force placed on said first pair of rolls is at least essentially independent of a position of said first pair of rolls. According to a further aspect of the present invention, the invention includes a belt of water absorbent material, wherein at least inside said at least one pressure chamber, the material web is arranged between a belt of water-absorbent material and membrane. According to still a further aspect of the invention, the belt of water-absorbent material comprises felt.

Further, one of the at least four substantially parallel rolls can be positionally fixed for rotation and arranged to support the material web as it is guided through the at least one pressure chamber. The one of the at least four substantially parallel rolls can include a surface at least one of grooved and blind bored. Alternatively, or additionally, the one of the at least four substantially parallel rolls may include a suction roll.

The apparatus may also include two side sealing plates arranged at opposite ends of the at least four substantially parallel rolls. At least one of the two side sealing plates may include a gas inlet coupled to the gas introduction device. At least a part of the pressurized gas introduced into the at least one pressure chamber can be introduced through said gas inlet.

According to another aspect of the present invention, a process is provided for dewatering a material web, including pressurizing at least one pressure chamber with a gas medium, guiding the material web through the pressure chamber, driving water out of the material web using gas pressure within the at least one pressure chamber, and changing an effective area of the pressure chamber so as to adjust a dewatering capacity.

In accordance with still another feature of the invention, the process may include removing the water driven out of the material web via one of a grooved and blind bored support roll.

Moreover, the process may also include removing the water driven out of the material web via one of a suctioned support roll.

In another aspect of the invention, the changing of the effective area comprises changing an effective length of the pressure chamber in a web travel direction.

According to a still further aspect of the present invention, the dewatering process can be performed using an apparatus that includes at least one pressure chamber formed by at least four substantially parallel rolls, a device arranged to introduce a pressurized gas into the at least one pressure chamber, and the at least four substantially parallel rolls being displaceable relative to one another, in which the material web is guided through the at least one pressure chamber. The process includes pressurizing the at least one pressure chamber through the introduction of the pressurized gas, and varying mechanical pressure exerted by the at least four substantially parallel rolls on the material web upon at least one of (1) entry into the at least one pressure chamber and (2) exit from the at least one pressure chamber, by changing the force with which the at least four substantially parallel rolls forming a respective nip are pressed against one another.

In accordance with a feature of the invention, the process can also include removing water from the material web through one of a grooved and blind bored surface of one of the at least four substantially parallel rolls.

According to still another feature of the instant invention, the process may include removing water from the material web through one of the at least four substantially parallel rolls which comprises a suctioned roll.

In accordance with yet another feature of the instant invention, the process may include changing an effective area of the at least one pressure chamber.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
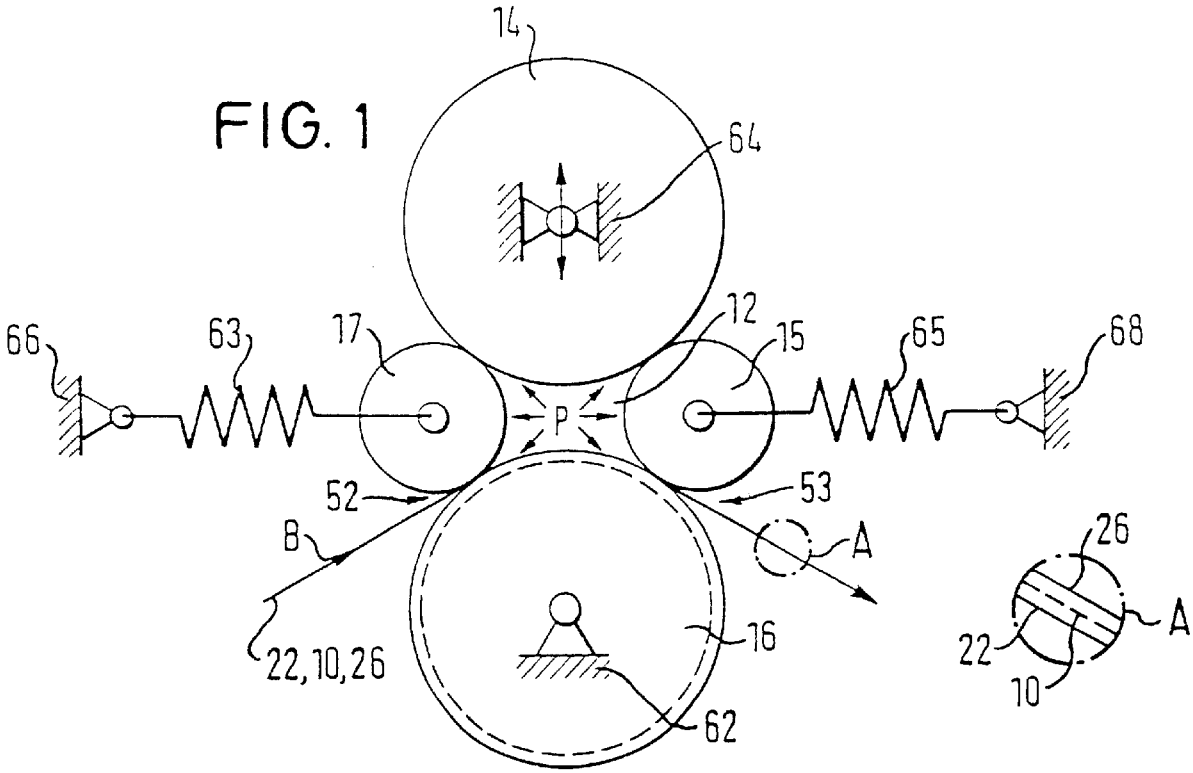
FIG. 1 illustrates a schematic side view of a dewatering device according to one embodiment of the invention.

The dewatering device according to FIG. 1 includes two large rolls 14, 16 and two small rolls 15, 17. The latter are also referred to as cap rolls. The four rolls 14–17 limit a pressure chamber 12. While the sealing of the pressure chamber 12 occurs in the radial direction, i.e., in directions perpendicular to the rotational axes of the rolls 14–17, by the rolls 14–17 that are resting against one another, side plates (not shown), for example, can be used to seal the pressure chamber 12 in the lateral direction. A pressurized gas, for example, pressurized air, can be introduced into the pressure chamber 12 by of one of these side plates in order to create a pressure "P" in the pressure chamber 12.

A material web 10 to be dewatered, for example, a paper or cardboard web, is guided through the pressure chamber 12 in the travel direction B. As is implied by the enlarged section A to the right in FIG. 1, the material web 10 is arranged between a belt 22 of water-absorbent material, for example, felt, and a membrane 26.

The arrangement of the material web 10, the felt 22, and the membrane 26 is guided in such a way that it wraps around the lower large roll 16 in FIG. 1. Thus, the material web 10 is resting against the jacket of the roll 16 with the felt 22 as an intermediate layer.

The material web 10, the felt 22, and the membrane 26 pass into the pressure chamber 12 through an entrance nip 52 formed by the lower roll 16 and the left smaller roll 17 and leave the pressure chamber 12 by way of an exit nip 53 formed by the lower roll 16 and the right small roll 15.

The dotted line on the lower roll 16 implies that the roll 16 and/or its roll jacket is provided with a surface structure, e.g., in the form of grooves or blind bores. The lower roll 16 is firmly fixed to a roll support 62, which is also referred to as a seating (or frame), in such a way that it can indeed be rotated, but a translating movement perpendicular to its lengthwise extension is not possible. Alternatively, or additionally, lower roll 16 can also be embodied as a suction roll.

On the other hand, as implied by the double arrow in FIG. 1, the large roll 14 across from the fixed roll 16 can be moved relative to a roll support and/or seating (or frame) 64 in such a way that the distance between the two large rolls 14, 16 can be changed by moving the upper roll 14.

Each of the two small rolls 15, 17 are coupled with a prestressing device 65, 63 that is supported on a stationary support 68, 66. Using these prestressing devices 65, 63, which can, for example, be embodied as pressure spring arrangements, the small rolls 15, 17 are each prestressed in contact with both of the large rolls 14, 16. The prestressing devices 65, 63 can each engage the end regions of the rolls 15, 17.

In operation of the dewatering device according to the invention, the pressurized gas that is introduced into the pressure chamber 12 through the gas-permeable membrane 26 and is pressed through the material web 10 to be dewatered, whereby the water is driven out of the material web 10 and into the felt 22. The removal of the water that is driven out of the material web 10 occurs by means of the felt 22 and the surface structure of the roll 16.

The membrane 26 produces a mechanical pressure on the surface of the material web 10, whereby the dewatering effect of the pressurized gas in the pressure chamber 12 is increased.

The configuration of the rolls 14–17 and thus the geometry and/or form of the pressure chamber 12 is determined by the distance between the two large rolls 14, 16. Each distance between the rolls 14, 16 corresponds to a dewatering path to be traveled by the material web 10 between the entrance nip 52 and the exit nip 53 and to a dwell time of the material web 10 inside the pressure chamber 12, which is dependent upon the web speed.

In order to change the dwell time, the upper roll 14 is moved towards or away from the lower roll 16, whereupon the prestressed small rolls 15, 17 can follow this adjusting movement due to their mounting, which allows an essentially free mobility.

If the upper roll 14 in FIG. 1 is moved downwardly and thus toward the lower roll 16, the two small rolls 15, 17 are pressed apart from another so that the dewatering path is enlarged and, if the web speed remains constant, the dwell time of the material web 10 inside the pressure chamber 12 is increased. In this way, the dewatering capacity of the dewatering device according to the invention is increased.

On the other hand, if the upper roll 14 is moved upwardly and thus is moved away from the lower roll 16, the small rolls 15, 17 automatically move toward one another because of their prestressing, whereby the dewatering path is reduced and the dwell time is decreased. In this way, a reduction in dewatering capacity is achieved thereby.

The possibility according to the invention of adjusting the dewatering capacity allows changes that effect the dewaterability of the material web 10, e.g., changes of the surface-dependent mass, i.e., of the basis weight, of the material web 10, changes in machine speed, and/or changes in the furnish, to be taken into account in an advantageous manner.

The prestressing of the small rolls 15, 17 guarantees that the small rolls 15, 17 are in contact with both of the large rolls 14, 16 at all times and the pressure chamber 12, which can be adjusted by the adjusting movement of the upper roll 14 with respect to its geometry and/or form, is limited by the four rolls 14–17 at all times.

Figure 2:
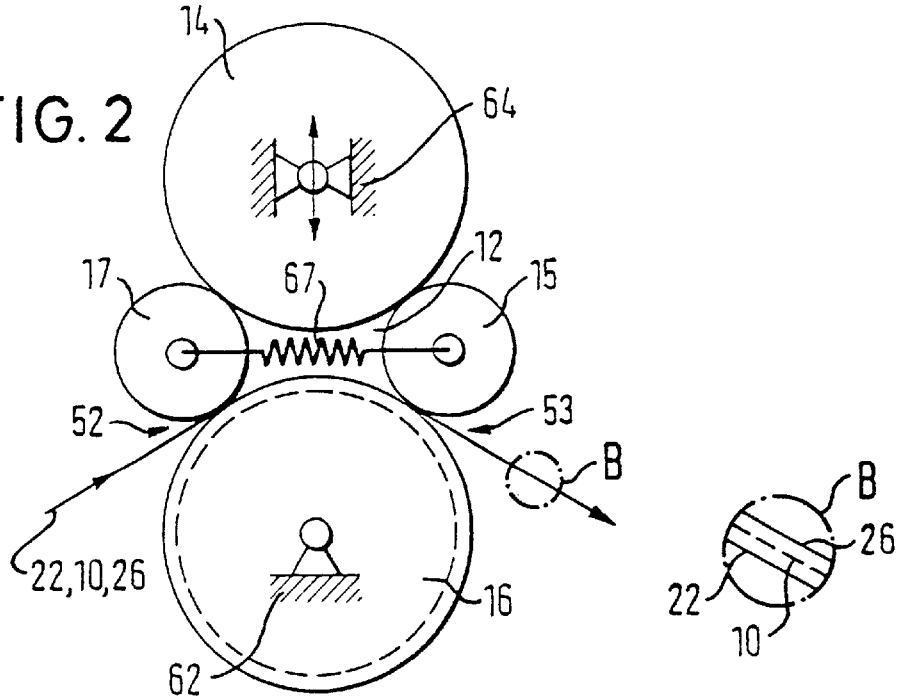
FIG. 2 illustrates a view according to FIG. 1 of a dewatering device according to a further embodiment of the invention.

The dewatering device according to the invention shown in FIG. 2 is different from the one in FIG. 1 in the manner in which the prestressing of the small rolls 15, 17 is achieved. The rolls 15, 17 are connected with one another by a prestressing device 67, by which the rolls 15, 17 are pulled towards one another. The prestressing device 67 can be a tension spring arrangement, for example. The prestressing device 67 pulls both of the rolls 15, 17 into contact with the two large rolls 14, 16 so that the rolls 15, 17 can follow an adjusting movement of the upper large roll 14 and are in contact with both large rolls 14, 16 at all times.

As is shown by the enlarged section B to the right in FIG. 2, the material web 10, which enters the pressure chamber 12 through an entrance nip 52 and is guided out of the pressure chamber 12 through an exit nip 53, is arranged between a dewatering felt 22 and a membrane 26 according to the embodiment of FIG. 1.

The prestressing devices 65, 63 of the embodiment according to FIG. 1 and the prestressing device 67 of the embodiment according to FIG. 2 are each embodied in such a way that, the prestressing force placed upon the respective roll 15, 17 is essentially independent of the roll position, i.e., the small rolls 15, 17 are pressed with an at least approximately directionally independent constant force against the two large rolls 14, 16 at all times.

In both of the embodiments described above according to FIGS. 1 and 2, the material web 10 is guided once through the pressure chamber 12. It is fundamentally possible according to the invention to provide for two passes through the pressure chamber 12 for the material web 10, i.e., to guide the material web 10 two consecutive times through the pressure chamber 12.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Material web
12 Pressure chamber
14 Large roll
15 Small roll
16 Large roll
17 Small roll
22 Belt, felt
26 Membrane
52 Entrance nip
53 Exit nip
62 Roll support
63 Prestressing device
64 Roll support
65 Prestressing device
66 Support
67 Prestressing device
68 Support
B Web travel direction

What is claimed:

1. An apparatus for dewatering a material web, comprising:

at least one pressure chamber formed by at least four substantially parallel rolls;

a device arranged to introduce a pressurized gas into said at least one pressure chamber; and said at least four substantially parallel rolls being displaceable relative to one another to change an effective area of the at least one pressure chamber, wherein the material web is guided through said at least one pressure chamber.

2. An apparatus according to claim 1, wherein the material web is one of a paper and cardboard web.

3. An apparatus according to claim 1, wherein water is driven out of the material web using the pressurized gas.

4. The apparatus according to claim 1, wherein positions of said at least four substantially parallel rolls are adjustable while a pressure within said at least one pressure chamber is maintained.

5. The apparatus according to claim 1, wherein a first pair of rolls of said at least four substantially parallel rolls are configured across from one another and a position of said first pair of rolls is adopted to follow a movement of at least one of the remaining rolls of said at least four substantially parallel rolls.

6. The apparatus according to claim 5, further comprising a roll support, wherein one roll of said first pair of rolls is fixed firmly on said roll support and an other of said first pair of rolls is mounted for movement relative to said fixed one roll.

7. The apparatus according to claim 1, further comprising at least one prestressing device, wherein a first pair of rolls of said at least four substantially parallel rolls are configured across from one another, wherein said at least one prestressing device is arranged to prestress said first pair of rolls in contact with the remaining rolls of said at least four substantially parallel rolls by at least one prestressing device, and wherein a distance between said remaining rolls is adjustable.

8. The apparatus according to claim 7, wherein said first pair of rolls have a smaller diameter than said remaining rolls of said at least four substantially parallel rolls.

9. The apparatus according to claim 8, wherein said first pair of rolls have a substantially smaller diameter than said remaining rolls of said at least four substantially parallel rolls.

10. The apparatus according to claim 7, further comprising at least one stationary support, wherein each roll of said first pair of rolls are coupled to said at least one stationary support by said at least one prestressing device.

11. The apparatus according to claim 10, wherein said at least one prestressing device comprises a pressure spring arrangement.

12. The apparatus according to claim 7, wherein said at least one prestressing device comprises a pressure spring arrangement.

13. The apparatus according to claim 7, wherein said at least one prestressing device is arranged to couple said first pair of rolls to one another.

14. The apparatus according to claim 13, wherein said at least one prestressing device is a tension spring arrangement.

15. The apparatus according to claim 7, wherein said at least one prestressing device is structured and arranged in such a way that prestressing force placed on said first pair of rolls is at least essentially independent of a position of said first pair of rolls.

16. The apparatus of claim 1, further comprising a belt of water absorbent material, wherein at least inside said at least one pressure chamber, the material web is arranged between a belt of water-absorbent material and membrane.

17. The apparatus of claim 16, wherein said belt of water-absorbent material comprises felt.

18. The apparatus of claim 1, wherein one of said at least four substantially parallel rolls is positionally fixed for rotation and arranged to support the material web as it is guided through said at least one pressure chamber.

19. The apparatus of claim 18, wherein said one of said at least four substantially parallel rolls comprises a surface at least one of grooved and blind bored.

20. The apparatus of claim 18, wherein said one of said at least four substantially parallel rolls comprises a suction roll.

21. The apparatus of claim 1, further comprising two side sealing plates arranged at opposite ends of said at least four substantially parallel rolls.

22. The apparatus of claim 21, wherein at least one of said two side sealing plates comprises a gas inlet coupled to said gas introduction device.

23. The apparatus of claim 22, wherein at least a part of said pressurized gas introduced into said at least one pressure chamber is introduced through said gas inlet.

24. A process for dewatering a material web, comprising:

pressurizing at least one pressure chamber with a gas medium;

guiding the material web through the pressure chamber;

driving water out of the material web using gas pressure within the at least one pressure chamber; and changing an effective area of the pressure chamber so as to adjust a dewatering capacity.

25. The process according to claim 24, wherein said material web is one of a paper or cardboard web.

26. The process according to claim 25, wherein the changing of the effective area comprises changing an effective length of the pressure chamber in a web travel direction.

27. The process according to claim 24, further comprising removing the water driven out of the material web via one of a grooved and blind bored support roll.

28. The process according to claim 24, further comprising removing the water driven out of the material web via one of a suctioned support roll.

29. A process for dewatering a material web using an apparatus comprising at least one pressure chamber formed by at least four substantially parallel rolls; a device arranged to introduce a pressurized gas into the at least one pressure chamber; the at least four substantially parallel rolls being displaceable relative to one another, wherein the material web is guided through the at least one pressure chamber, the process comprising:

pressurizing the at least one pressure chamber through the introduction of the pressurized gas; and varying mechanical pressure exerted by the at least four substantially parallel rolls on the material web upon at least one of (1) entry into the at least one pressure chamber and (2) exit from the at least one pressure chamber, by changing the force with which the at least four substantially parallel rolls forming a respective nip are pressed against one another.

30. The process according to claim 29, further comprising removing water from the material web through one of a grooved and blind bored surface of one of the at least four substantially parallel rolls.

31. The process according to claim 29, further comprising removing water from the material web through one of the at least four substantially parallel rolls which comprises a suctioned roll.

32. The process according to claim 29, further comprising changing an effective area of the at least one pressure chamber.

* * * * *